US012188697B2

(12) United States Patent
Zhao et al.

(10) Patent No.: US 12,188,697 B2
(45) Date of Patent: Jan. 7, 2025

(54) HEAT PUMP ADAPTER SYSTEM

(71) Applicant: UNIVERSITY OF HULL, Hull (GB)

(72) Inventors: Xudong Zhao, Hull (GB); Jing Li, Hull (GB); Yi Fan, Hull (GB); Ali Badiei, Hull (GB); Min Yu, Hull (GB); Steve Myers, Hull (GB)

(73) Assignee: UNIVERSITY OF HULL, Hull (GB)

( * ) Notice: Subject to any disclaimer, the term of this patent is extended or adjusted under 35 U.S.C. 154(b) by 291 days.

(21) Appl. No.: 17/777,020

(22) PCT Filed: Nov. 16, 2020

(86) PCT No.: PCT/GB2020/052924
§ 371 (c)(1),
(2) Date: May 14, 2022

(87) PCT Pub. No.: WO2021/094787
PCT Pub. Date: May 20, 2021

(65) Prior Publication Data

US 2022/0404073 A1 Dec. 22, 2022

(30) Foreign Application Priority Data

Nov. 15, 2019 (GB) ..... 1916710

(51) Int. Cl.
*F25B 41/26* (2021.01)
*F25B 30/02* (2006.01)
*F25B 49/02* (2006.01)

(52) U.S. Cl.
CPC ..... *F25B 41/26* (2021.01); *F25B 30/02* (2013.01); *F25B 49/02* (2013.01)

(58) Field of Classification Search
CPC ..... F25B 41/26; F25B 30/02; F25B 49/02
See application file for complete search history.

(56) References Cited

U.S. PATENT DOCUMENTS 5,651,258 A 7/1997 Harris
5,899,091 A 5/1999 Fraser, Jr.
(Continued)

FOREIGN PATENT DOCUMENTS

CN 109737641 A 5/2019
CN 110168288 A 8/2019
(Continued)

OTHER PUBLICATIONS

State IP Office First Review Opinion Notice; Dated Mar. 12, 2024.

*Primary Examiner* — Henry T Crenshaw
(74) *Attorney, Agent, or Firm* — HGF LIMITED; Brian Burkinshaw

(57) ABSTRACT

A heat pump system having a common refrigerant flow path split coupled to heating mode first and second refrigerant streams. In the common refrigerant flow path, a compressor is coupled to receive refrigerant from the heating mode first refrigerant stream and the heating mode second refrigerant stream. A refrigerant-to-refrigerant heat exchanger couples heat between the heating mode first refrigerant stream and the heating mode second refrigerant stream. A first refrigerant-air heat exchanger and a second refrigerant-air heat exchanger in a second air flow conduit is coupled to receive a first air flow from a first refrigerant-air heat exchanger in a first air flow conduit.

13 Claims, 7 Drawing Sheets

(56) References Cited

U.S. PATENT DOCUMENTS

| | | | | |
|---|---|---|---|---|
| 9,605,883 | B2 * | 3/2017 | Katoh | F28F 27/02 |
| 2007/0180852 | A1 * | 8/2007 | Sugiura | F25B 41/00 62/170 |
| 2013/0205824 | A1 * | 8/2013 | Morimoto | F25B 30/02 62/332 |
| 2019/0154322 | A1 * | 5/2019 | Ito | F25B 45/00 |
| 2021/0039474 | A1 * | 2/2021 | Kim | B60H 1/00278 |

FOREIGN PATENT DOCUMENTS

| | | | |
|---|---|---|---|
| JP | WO2013/140918 | A1 | 9/2013 |
| JP | WO 2018/198609 | A1 | 11/2018 |

* cited by examiner

200'
EVP2'
B2'
S
L2scb'
Q1
TEV1
TV1
L0'
Q2
TV2
W1
A2
IN2
V2'
RV1
V0sh'
V2'
COMP
V1'
F2
PS
TS2
OUT
C1
F1
SUBC0'
CONDO0'
C2
F3
A1
A3
IN1
L0'
CM
W2
Q3
TV3
TEV2
L1sc'
W4
L2sca'
HX
B1'
L0sc'
RV2
L2scb'
V1'
TS1

HEAT PUMP ADAPTER SYSTEM

This application claims the benefit of PCT/GB2020/0522924 filed on 16 Nov. 2020 under 35 USC § 365.

TECHNICAL FIELD

The present invention relates to heat pumps and more particularly, but not exclusively, to heat pumps for domestic and commercial premises.

BACKGROUND

A large proportion of the energy footprint of buildings is consumed in heating the interior of the building, with a substantial proportion of the heating loss being through ventilation, commonly 30%. Traditionally, buildings have been ventilated by releasing exhaust air directly from the interior to the exterior of the building, wasting the heat carried by the exhaust air. In active heat recovery, exhaust air heat pumps have been used to extract heat from exhaust air, with the heat being pumped into the fresh supply air, or supplied to a heating element within the interior of the building. However, there remains a need to improve the heating of buildings using heat pump systems.

SUMMARY OF THE DISCLOSURE

According to a first aspect, there is provided a heat pump adaptor system for coupling to the refrigerant flow path and air flow path of a heat pump to form a heat pump system with a heating mode refrigerant flow path comprising:

a compressor coupled to receive refrigerant from a heating mode first refrigerant stream and a heating mode second refrigerant stream of the heating mode refrigerant flow path;

a common condenser coupled to receive a common refrigerant flow from the compressor; and a heat exchanger for transferring heat between the heating mode first refrigerant stream and the heating mode second refrigerant stream; and a heating mode refrigerant flow splitter for splitting the common refrigerant flow into the heating mode first refrigerant stream and heating mode second refrigerant stream, wherein the heating mode first refrigerant stream comprises:

a first expansion valve coupled to receive refrigerant from the common condenser;

a first evaporator coupled to receive refrigerant from the first expansion valve; and the heat exchanger coupling the heating mode first refrigerant stream from the first evaporator to the compressor, wherein the heating mode second refrigerant stream comprises:

a second expansion valve;

the heat exchanger coupling the heating mode second refrigerant stream from the common condenser to the second expansion valve; and the second evaporator being coupled to communicate refrigerant from the second expansion valve to the compressor, wherein the first evaporator is in a first air flow conduit with a first air inlet for receiving a first air flow, and the second evaporator is in a second air flow conduit coupled to receive the first air flow, wherein the heat pump comprises: the compressor; the common condenser; the second expansion valve; the second evaporator; and the second air flow conduit, and wherein the heat pump adaptor system comprises: the first expansion valve; the first evaporator; the heat exchanger; and the first air flow conduit.

According to a second aspect, there is provided a heat pump system, in accordance with the first aspect, and with a heating mode refrigerant flow path comprising:

the compressor coupled to receive refrigerant from the heating mode first refrigerant stream and the heating mode second refrigerant stream of the heating mode refrigerant flow path;

the common condenser coupled to receive a common refrigerant flow from the compressor;

a heat exchanger for transferring heat between the heating mode first refrigerant stream and the heating mode second refrigerant stream; and a heating mode refrigerant flow splitter for splitting the common refrigerant flow into the heating mode first refrigerant stream and heating mode second refrigerant stream, wherein the heating mode first refrigerant stream comprises:

the first expansion valve coupled to receive refrigerant from the common condenser;

the first evaporator coupled to receive refrigerant from the first expansion valve; and the heat exchanger coupling the heating mode first refrigerant stream from the first evaporator to the compressor, wherein the heating mode second refrigerant stream comprises:

the second expansion valve;

the heat exchanger coupling the heating mode second refrigerant stream from the common condenser to the second expansion valve; and the second evaporator being coupled to communicate refrigerant from the second expansion valve to the compressor, wherein the first evaporator is in a first air flow conduit with a first air inlet for receiving a first air flow, and the second evaporator is in a second air flow conduit coupled to receive the first air flow.

According to a third aspect, there is provided a method of heating a building provided with a heat pump system with a heating mode refrigerant flow path comprising:

a compressor coupled to receive refrigerant from a heating mode first refrigerant stream and a heating mode second refrigerant stream of the heating mode refrigerant flow path;

a common condenser coupled to receive a common refrigerant flow from the compressor; and a heat exchanger for transferring heat between the heating mode first refrigerant stream and the heating mode second refrigerant stream; and a heating mode refrigerant flow splitter for splitting the common refrigerant flow into the heating mode first refrigerant stream and heating mode second refrigerant stream, wherein the heating mode first refrigerant stream comprises:

a first expansion valve coupled to receive refrigerant from the common condenser;

a first evaporator coupled to receive refrigerant from the first expansion valve; and the heat exchanger coupling the heating mode first refrigerant stream from the first evaporator to the compressor, wherein the heating mode second refrigerant stream comprises:

a second expansion valve;

the heat exchanger coupling the heating mode second refrigerant stream from the common condenser to the second expansion valve; and the second evaporator being coupled to communicate refrigerant from the second expansion valve to the compressor, wherein the first evaporator is in a first air flow conduit with a first air inlet for receiving a first air flow, and the second evaporator is in a second air flow conduit coupled to receive the first air flow, the method comprising:

emitting heat from the common condenser by circulating refrigerant through the heating mode refrigerant flow path; and passing building exhaust air through the first evaporator and the second evaporator.

According to a fourth aspect, there is provided a method of cooling a building provided with a heat pump system with a cooling mode refrigerant flow path comprising:

a compressor coupled to receive refrigerant from a cooling mode first refrigerant stream and a cooling mode second refrigerant stream of a cooling mode refrigerant flow path;

a common condenser coupled to receive refrigerant from the compressor;

a common subcooler coupled to receive refrigerant from the common condenser;

a heat exchanger for transferring heat between the cooling mode first refrigerant stream and the cooling mode second refrigerant stream, and a cooling mode refrigerant flow splitter for splitting the common refrigerant flow into the cooling mode first refrigerant stream and cooling mode second refrigerant stream, wherein the cooling mode first refrigerant stream comprises:

a second expansion valve coupling the cooling mode first refrigerant stream to the heat exchanger; and the heat exchanger coupling the cooling mode first refrigerant stream to the compressor, wherein the cooling mode second refrigerant stream comprises:

the heat exchanger coupling the cooling mode second refrigerant stream to a first expansion valve; and a cooling mode second refrigerant stream evaporator coupling the second refrigerant stream from the first expansion valve to the compressor, the method comprising:

absorbing heat by the cooling mode second refrigerant stream evaporator by circulating refrigerant through the cooling mode refrigerant flow path; and passing building exhaust air through the common subcooler a common condenser.

The first air flow conduit may be provided with a first air pump for pumping air through the first air inlet.

The heat pump adaptor system may comprise a mixing chamber having a second air inlet provided for receiving and mixing air from the first air flow conduit and the second air inlet to form a mixed air flow and for coupling the mixed air flow to the second air flow conduit.

The second air inlet may be provided with a third air pump for pumping air into the mixing chamber from the second air flow conduit.

The mixing chamber may be provided with a perforated screen, and air from the first air flow conduit and the second air inlet may be coupled to the second air flow conduit by passage through the perforated screen.

The compressor may have first and second gas inlets.

The compressor may be a vapour injection compressor. The vapour injection compressor may be a vapour injection scroll compressor. The vapour injection compressor may be a vapour injection screw compressor. The vapour injection compressor may be a multistage centrifugal compressor.

The first evaporator may be provided within a first evaporator refrigerant conduit and have a first external surface area for exposure to air in the first air flow conduit, the second evaporator may be provided within a second evaporator refrigerant conduit and have a second external surface area for exposure to air in the second air flow conduit, and the second external surface area may be larger than the first external surface area.

The first air flow conduit may be provided with a first air pump for pumping air through the first air flow conduit.

The second air flow conduit may be provided with a second air pump for pumping air through the second air flow conduit.

A mixing chamber having a second air inlet may be provided for receiving and mixing air from the first air flow conduit and the second air inlet to form a mixed air flow and for coupling the mixed air flow to the second air flow conduit.

The second air inlet may be provided with a third air pump for pumping air into the mixing chamber from the second air flow conduit.

The mixing chamber may be provided with a perforated screen, and air from the first air flow conduit and the second air inlet may be coupled to the second air flow conduit by passage through the perforated screen.

The heat pump system may be configured for switching between a heating mode of operation and a cooling mode of operation.

The refrigerant flow path may comprise switchable valves that are switchable to close portions of the refrigerant flow path for the heating mode of operation, and to open alternative refrigerant flow paths to provide a modified refrigerant flow path for the cooling mode of operation.

The heat pump system may comprise, in the cooling mode of operation:

the compressor coupled to receive refrigerant from a cooling mode first refrigerant stream and a cooling mode second refrigerant stream of the cooling mode refrigerant flow path;

the second evaporator of the heating mode coupled as a common condenser coupled to receive refrigerant from the compressor;

the first evaporator of the heating mode as a common subcooler coupled to receive refrigerant from the common condenser; and a heat exchanger for transferring heat between the cooling mode first refrigerant stream and the cooling mode second refrigerant stream, a cooling mode refrigerant flow splitter for splitting the common refrigerant flow into the cooling mode first refrigerant stream and cooling mode second refrigerant stream, wherein the cooling mode first refrigerant stream comprises:

the second expansion valve coupling the cooling mode first refrigerant stream to the heat exchanger; and the heat exchanger coupling the cooling mode first refrigerant stream to the compressor, and wherein the cooling mode second refrigerant stream comprises:

the heat exchanger coupling the cooling mode second refrigerant stream to the first expansion valve; and the common condenser of the heating mode as a second refrigerant stream evaporator coupling the second refrigerant stream from the first expansion valve to the compressor.

The heat pump system may comprise a mixing chamber having a second air inlet provided for receiving and mixing air from the first air flow conduit and the second air inlet to form a mixed air flow and for coupling the mixed air flow to the second air flow conduit, the method may comprise:

mixing a second air flow into the first air flow, and passing the mixed first and second air flows through the second evaporator.

The heat pump system may comprise a mixing chamber having a second air inlet provided for receiving and mixing air from the first air flow conduit and the second air inlet to form a mixed air flow and for coupling the mixed air flow to the second air flow conduit, the method comprising:

mixing a second air flow into the first air flow, and passing the mixed first and second air flows through the common condenser.

DESCRIPTION OF THE DRAWINGS

Examples are further described hereinafter with reference to the accompanying drawings, in which.

DETAILED DESCRIPTION

In the described examples, like features have been identified with like numerals, albeit in some cases having one or more suffix letters. For example, in different figures, L0, L1, L2, L2*sc*, L0', L0*sc*', L1*sc*', L2*sca*' and L2*scb*' have been used to indicate liquid refrigerant.

Figure 1A:
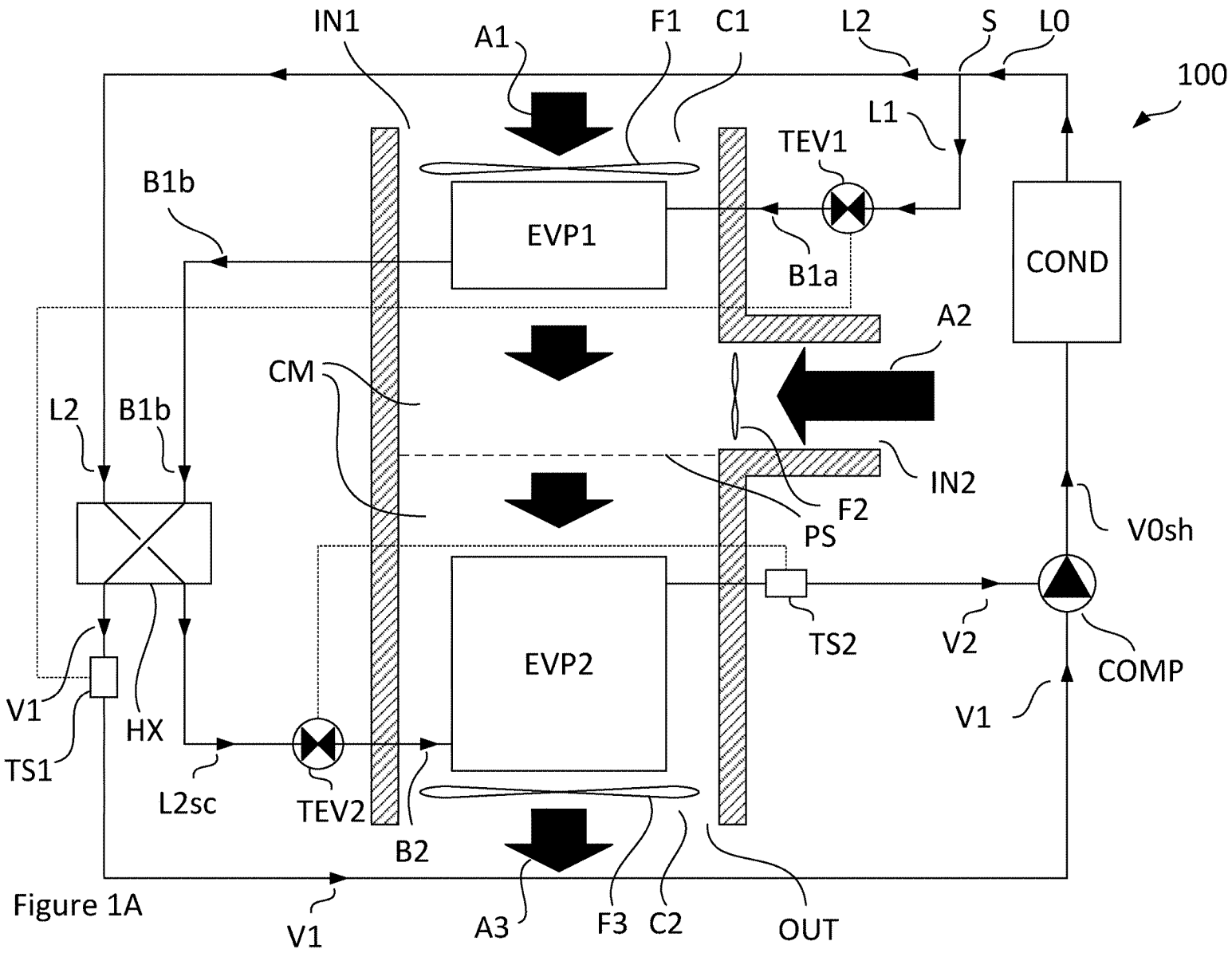
FIG. 1A schematically illustrates a heat pump system in a heating mode of operation.

FIG. 1A schematically illustrates the refrigerant flow path (refrigerant pathway) and air flow path (air pathway) of a heat pump system 100, in a heating operation mode. The refrigerant flows around a closed, streamed circuit (the refrigerant is split from a common refrigerant flow from the common condenser COND between parallel heating mode first and second streams), recovering heat from exhaust air A1 flowing through the heat pump system 100, and transferring the heat to a condenser COND (refrigerant-load heat exchanger), which dissipates heat into the interior of the building (e.g. to radiators) or into a supply of ventilation air (e.g. into the building), as a thermal load on the heat pump system.

The air flow path has a first air inlet IN1 for receiving exhaust air flow A1 (e.g. at 20° C.) from a building into a first air flow conduit C1. A first evaporator EVP1 (first refrigerant-air heat exchanger) is provided within the first air flow conduit C1 for recovering heat from the exhaust air flow A1 flowing through the first evaporator EVP1, and transferring the recovered heat into the refrigerant passing through the first evaporator EVP1. The air leaving the first air flow conduit C1 (e.g. at 10° C.) is coupled into a second air flow conduit C2. A second evaporator EVP2 (second refrigerant-air heat exchanger) is provided within the second air flow conduit C2 for recovering heat from the air flowing through the second evaporator EVP2, and transferring the recovered heat into the refrigerant passing through the second evaporator EVP2 before the outlet air flow A3 (e.g. at −3° C.) is coupled out of the air outlet OUT.

In the illustrated heat pump system 100, the air flow path is (optionally) provided with a second air inlet IN2 for receiving ambient air flow A2 (e.g. at 1° C.), which is mixed with the exhaust air flow A1 in a mixing chamber (mixing conduit) CM, before the mixed exhaust air flow A1 and ambient air flow A2 (e.g. mixed air at 2° C.) flow into the second air flow conduit C2. The illustrated mixing chamber CM is additionally (optionally) provided with a perforated screen PS to enhance mixing of the exhaust air flow A1 received from the first evaporator EVP1 and the ambient air flow A2 from the second air inlet IN2.

The heat pump system 100 may be provided with one or more fans F1, F2, F3 to drive the air flow A1, A2, A3 through the air flow path. Alternatively, the air flow(s) may be driven by external components to which the air flow path of the heat pump system 100 is coupled. In the case that the heat pump system 100 is provided with a second air inlet IN2 for receiving and mixing ambient air flow A2 into the exhaust air flow A1, the provision of two or more fans F1, F2, F3 in, or coupled to, different air flow conduits (first air inlet IN1, second air inlet IN2, air mixing chamber MC, and the air outlet OUT) enables control of the ratio of the exhaust air flow A1 and the ambient air flow A2.

Figure 1B:
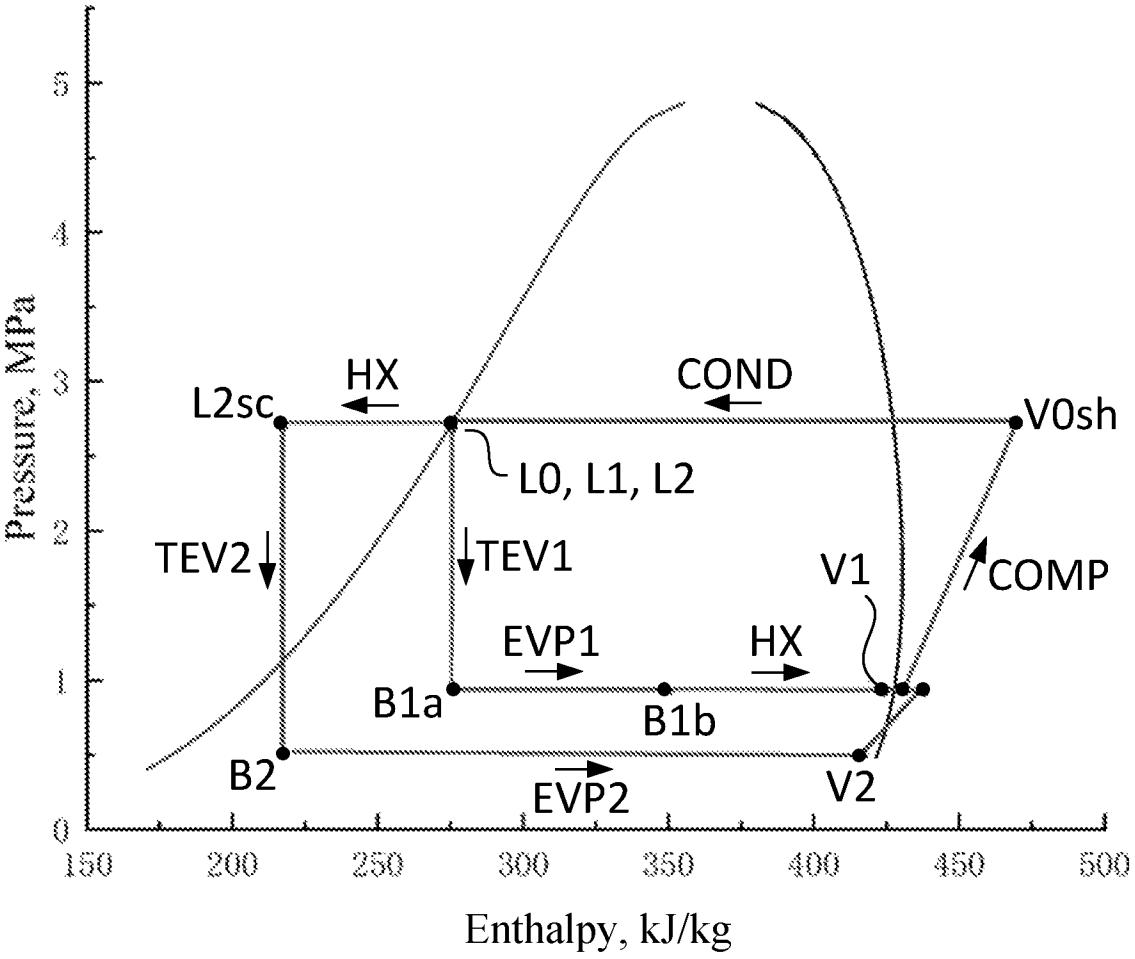
FIG. 1B shows a pressure-enthalpy diagram for heating mode of operation of the heat pump system of FIG. 1A, for the refrigerant R-410A.

The heating mode refrigerant flow path forms a closed, streamed refrigerant circuit around which the refrigerant circulates, in use, which is described below, for the refrigerant R-410A. FIG. 1B shows the pressure-enthalpy diagram for the heating mode operation of the heat pump system 100 of FIG. 1A, also for the refrigerant R-410A.

In the heating mode common refrigerant stream:

i. The compressor COMP (e.g. a vapour injection compressor) supplies a common flow of refrigerant as superheated vapour V0*sh* to the condenser COND (e.g. 74.7° C., 2.73 MPa). The compressor COMP has a higher pressure gas inlet and a lower pressure gas inlet, respectively receiving refrigerant flows V1 and V2.

ii. The common condenser COND emits heat, e.g. into a water flow supplying heat to radiators in the interior of the building in which the heat pump system 100 is installed, or directly into air within the building. The common condenser COND cools the common flow of superheated vapour V0*sh* and condenses the refrigerant into a common flow of liquid L0 (e.g. 45.0° C., 2.73 MPa).

iii. The common flow of liquid L0 output from the condenser COND is split by a three-way connector S into two liquid refrigerant flows L1, L2 (e.g. 45.0° C., 2.73 MPa), respectively flowing through a first and a second refrigerant stream of the refrigerant flow path.

A vapour injection compressor is adapted to compress both a lower pressure and a higher pressure gas stream, and is particularly suited for use as the compressor in the present heat pump system. A vapour injection compressor may improve performance of the heat pump system, by reducing thermodynamic irreversibility during the throttling process, which may be particularly beneficial when the temperature difference between the hot and cold sides of the heat pump system is large. The compressor COMP may be a vapour injection scroll compressor. The vapour injection compressor may be a vapour injection screw compressor or a multistage centrifugal compressor.

In the heating mode first refrigerant stream:

i. The flow of liquid refrigerant L1 (e.g. 45.0° C., 2.73 MPa) into the heating mode first refrigerant stream flows through a first throttle valve (expansion valve) TEV1, in which the pressure is abruptly dropped, causing flash evaporation of part of the liquid refrigerant L1 to form a lower dryness binary phase refrigerant B1*a* (e.g. 31.7% dryness) at a lower temperature (e.g. 5.0° C., 0.94 MPa).

ii. The lower dryness binary phase refrigerant B1*a* flows through the (higher pressure) first evaporator EVP1, in which the dryness of the refrigerant is increased to form a higher dryness binary phase refrigerant B1*b* (e.g. 65.6% dryness, at 5.0° C., 0.94 MPa).

iii. The higher dryness binary phase refrigerant B1*b* flows through the internal heat exchanger (refrigerant-to-refrigerant) HX, absorbing heat from the liquid refrigerant L2 in the heating mode second refrigerant stream, to form a heating mode first refrigerant stream vapour V1 (which may be a saturation vapour, e.g. 100% dryness, at 5° C., 0.94 MPa).

iv. The heating mode first refrigerant stream vapour V1 flows back to the higher pressure input of compressor COMP, where it is recombined with the heating mode second refrigerant stream vapour V2 and compressed into the common flow of superheated vapour V0*sh* output (e.g. 74.7° C., 2.73 MPa). The temperature of the vapour V1 is measured by the first temperature sensor TS1.

In the binary phase refrigerant, dryness is defined as follows:

binary phase dryness=mass of vapour/(total mass of vapour and liquid)

In the heating mode second refrigerant stream:

i. The liquid refrigerant L2 (e.g. 45.0° C., 2.73 MPa) flows through the heat exchanger HX, passing heat to the higher dryness binary phase refrigerant B1*b* in the heating mode first refrigerant stream, to form a subcooled refrigerant flow L2*sc* (e.g. 11.2° C., 2.73 MPa).

ii. The flow of subcooled refrigerant L2*sc* flows through a second throttle valve (expansion valve) TEV2, in which the pressure is abruptly dropped, causing flash evaporation of part of the subcooled refrigerant flow L2*sc* to form a second binary phase refrigerant B2 (e.g. 11% dryness) at a lower temperature (e.g. −12.8° C., 0.52 MPa).

iii. The second binary phase refrigerant B2 flows through the (lower pressure) second evaporator EVP2, in which the residual liquid refrigerant is completely vaporised to form a heating mode second refrigerant stream vapour V2 (e.g. −12.8° C., 0.52 MPa).

iv. The heating mode second refrigerant stream vapour V2 flows back to the lower pressure input of compressor COMP, where it is recombined with the heating mode first refrigerant stream vapour V1 and compressed into a common flow of superheated vapour V0*sh* output (e.g. 74.7° C., 2.73 MPa). The temperature of the vapour V2 is measured by the second temperature sensor TS2.

As a result of the transfer of heat from the liquid refrigerant L2 in the heating mode second refrigerant stream to the higher dryness binary phase refrigerant B1*b* in the heating mode first refrigerant stream, within the heat exchanger (heating mode first refrigerant stream-to-second refrigerant stream heat exchanger) HX:

the refrigerant exiting the second throttle valve TEV2 and within the second evaporator EVP2 has a lower pressure than the refrigerant exiting the first throttle valve TEV1 and within the first evaporator EVP1; and the refrigerant vapour V2 in the heating mode second refrigerant stream returning to the compressor COMP has a lower pressure than the vapour V1 in the heating mode first refrigerant stream returning to the compressor COMP.

The described heating mode refrigerant temperatures and pressures correspond with a heat pump operating with −5.0° C. ambient air A2, 20° C. exhaust air flow A1 entering the first evaporator EVP1, 10° C. air flow exiting the first evaporator EVP1, and −7.8° C. outlet air flow A3.

The coefficient of performance (COP) of a heat pump is determined by the difference between the condensation and evaporation temperatures (the hot and cold side temperatures of the heat pump system, respectively), with a smaller difference producing a higher COP. The first evaporator EVP1 is exposed to the exhaust air flow A1 received by the heat pump system, which typically has a higher temperature than the air to which the second evaporator EVP2 is exposed (being the air that has flowed over the first evaporator, and which is optionally mixed with ambient air flow A2), resulting in a higher evaporation temperature in the first evaporator EVP1 than in the second evaporator EVP2. Through the use of two evaporators EVP1 and EVP2 in different refrigerant streams, with a higher evaporation temperature within the first evaporator EVP1, the present heat pump system effectively has a higher overall evaporation temperature, producing a higher COP.

A vapour injection compressor is adapted to compress a lower pressure and a higher pressure gas stream, and is particularly suited to the present heat pump system.

The mass flow rate through the heating mode second refrigerant stream (e.g. through the second evaporator EVP2) may be higher than the mass flow rate through the heating mode first refrigerant stream (e.g. through the first evaporator EVP1). The ratio of mass flow rates corresponds to the ratio of thermal recovery from the first and second evaporators EVP1, EVP2. Where the heat pump system provides all of the heat to a building, thermal loss by exhaust ventilation may be less than half of the total thermal loss of the building, and the more heat may be recovered from the heating mode second refrigerant stream than from the heating mode first refrigerant stream. The ratio of mass flow rates of the heating mode first refrigerant stream:heating mode second refrigerant stream may be between 0.4:1 and 0.9:1.

The ratio of mass flow rates in the heating mode first and second refrigerant streams may be controlled in correspondence with the ambient air temperature, the exhaust air temperature, the condensation temperature (e.g. temperature of load water circulating to the condenser COND), and the power of the compressor COMP. The first throttle valve TEV1 and the second throttle valve TEV2 may be controlled to regulate the mass flow rates in the heating mode first and second refrigerant streams, respectively.

The heating mode first and second refrigerant streams in the heat pump system may be respectively provided with a first temperature sensor TS1 for measuring the temperature of the vapour V1 output from the heat exchanger HX and flowing to the higher pressure input of the compressor COMP, and a second temperature sensor TS2 for measuring the temperature of the vapour V2 output from the second evaporator EVP2 and flowing to the low pressure input of the compressor COMP. The first and second temperature sensors TS1, TS2 respectively provide feedback used to control the first throttle valve TEV1 and the second throttle valve TEV2, ensuring that the refrigerant is fully vaporised at the locations of the temperature sensors TS1, TS2. In the heating mode first refrigerant stream, the first temperature sensor TS1 may be located downstream of the heat exchanger HX. In the heating mode second refrigerant stream, the second temperature sensor TS2 may be located downstream of the second evaporator EVP2. The temperature sensors TS1, TS2 provide temperature readings that respectively corresponds with the temperature of the refrigerant V1, V2 exiting the heat exchanger HX and the second evaporator EVP2, which is related to the temperature of the air flow A1, A2 passing through the evaporators EVP1, EVP2. The mass flow rates through the first throttle valve TEV1 and the second throttle valve TEV2 may be controlled in correspondence with the respective temperatures of the refrigerant vapours V1, V2 exiting the heat exchanger HX and the second evaporator EVP2.

A higher refrigerant V1, V2 temperature at the temperature sensor TS1, TS2 provides feedback that controls the throttle valve TEV1, TEV2 to increase the mass flow rate through the throttle valve TEV1, TEV2. If the temperature of the air flow A1, A2 passing into the evaporators EVP1, EVP2 changes, the mass flow rate through the throttle valves TEV1, TEV2 will change in correspondence.

Examples of suitable refrigerant are R-410A (a zeotropic, but near-azeotropic mixture of difluoromethane {R-32} and pentafluoroethane {R-125}), R-22 (Chlorodifluoromethane), or R-134A (1,1,1,2-Tetrafluoroethane).

Advantageously, the use of a second evaporator EVP2 and a heat exchanger HX that transfers heat from the liquid refrigerant flow L2 in the heating mode second refrigerant stream of the refrigerant circuit to the higher dryness binary phase refrigerant B1*b* in the heating mode first refrigerant stream, enables additional heat to be recovered from the exhaust air flow A1, beyond what would be recovered with only a single stage evaporator heat recovery process. Also, by the use of the heat exchanger HX, and the supporting refrigerant circuit, the heat pump system is able to recover more heat from exhaust air flow A1 than a two-stage evaporator heat recovering process without the heat exchanger and supporting refrigerant circuit.

Advantageously, the (optional) introduction and mixing of ambient air flow A2 into the air flow of exhaust air flow A1 enables the heat pump system to recover more heat, in total, from the air flow through the first and second conduits C1, C2 than is available from only the building exhaust air flow A1. Accordingly, the use of ambient air flow A2 enables the heat pump system 100 to supply a larger amount of heat than can be recovered only from the exhaust air flow A1, e.g. a single heat pump system can both recover heat from exhaust air and recover additional heat from ambient air, which may together supply all of the space heating requirements of a building.

The air flow leaving the first evaporator EVP1 would typically have a significantly higher temperature than the ambient air flow A2 (e.g. 5-10° C. higher than ambient), in heating mode, and so raises the temperature of the ambient air when mixed, which increases the heat recovery performance of the second evaporator EVP2. For typical conditions, the present heat pump system may provide a coefficient of performance (COP) that is 20-30% higher than for a conventional air source heat pump.

Conventional air source heat pumps are vulnerable to frosting, in which ice forms on the evaporator, which substantially reduces heat recovery performance and consequently reduces their commercial viability. In conventional air source heat pumps, it is typically necessary to supply significant additional energy (e.g. heating, or running the refrigerant cycle in reverse) to remove any build-up of ice. Advantageously, in the case where the present heat pump system uses ambient air, in addition to exhaust air, the problem of frosting is substantially reduced compared with a conventional air source heat pump, because the air entering the second evaporator EVP2 is warmer than ambient, because of being mixed with the exhaust air flow exiting the first evaporator EVP1. Further, even if the second evaporator EVP2 should become frosted with ice, that ice may be removed by stopping (or reducing) the flow of ambient air flow A2 into the mixing chamber CM, and stopping (or reducing) the flow of refrigerant through the first evaporator EVP1, so that the ice on the second evaporator EVP2 is melted by the heat in the exhaust air flow A1 (e.g. about 20° C. above ambient). Additionally, or alternatively, ice may be removed by increasing the exhaust air flow A1. Similarly, any ice on the first evaporator EVP1 will be melted by passing the exhaust air flow A1 through the first evaporator EVP1 whilst stopping (or reducing) the refrigerant flow through the first evaporator EVP1. Accordingly, the use of exhaust air flow A1 mixed with the ambient air flow A2 can reduce the energy consumption of the heat pump system compared with a conventional air source heat pump, in conditions susceptible to frosting.

The second evaporator EVP2 may have a larger surface area exposed to the air flow than the first evaporator EVP1. Advantageously, the larger surface area may facilitate greater thermal recovery by the second evaporator EVP2, than by the first evaporator EVP1. For example, the volume of ambient air flow A2 may be 300-600% of the volume of exhaust air flow A1 received at the first air inlet IN1 to the first conduit C1.

Figure 2A:
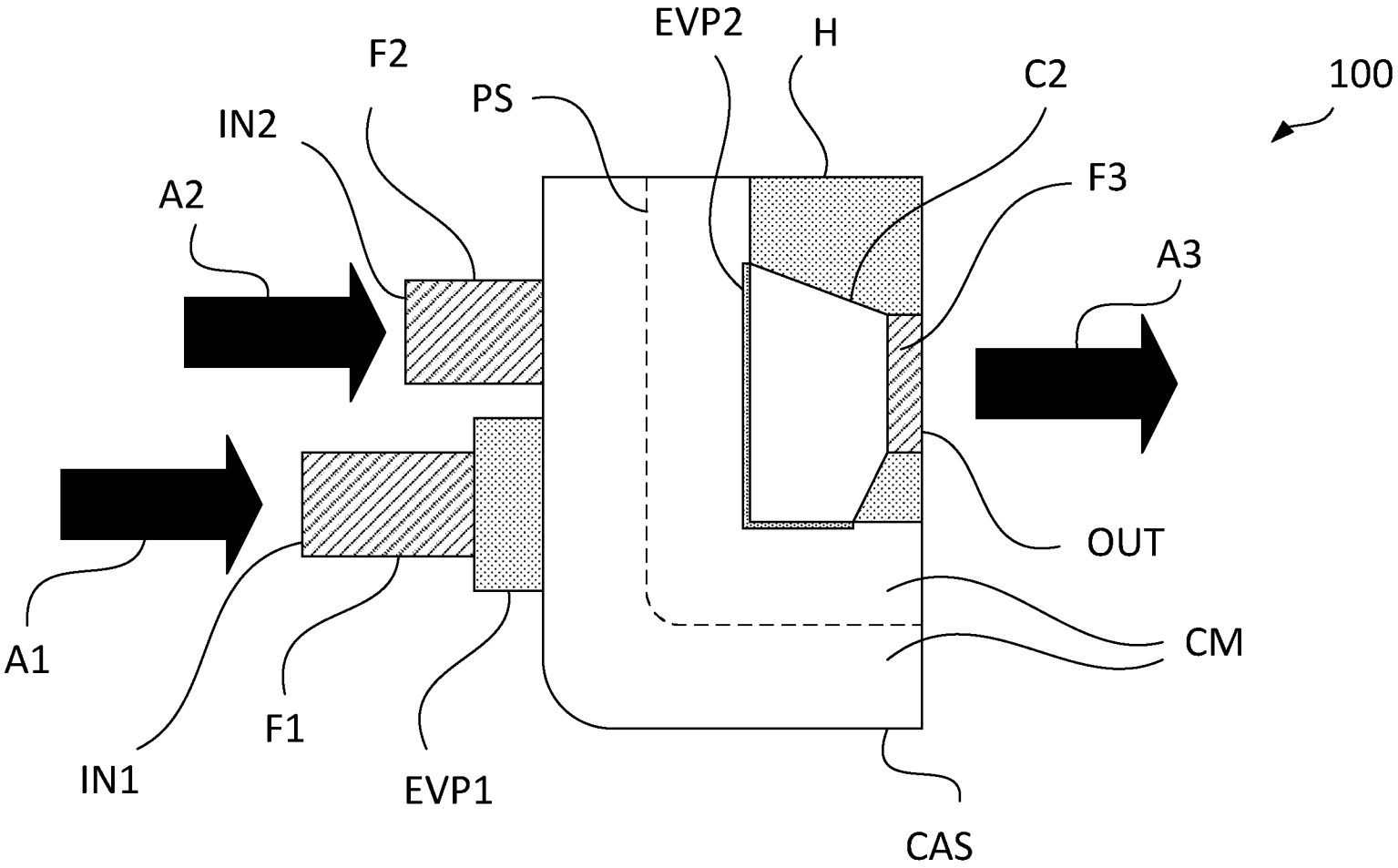
FIG. 2A shows a sectional view of a heat pump system.

FIG. 2A illustrates a plan view of the heat pump system 100 of FIG. 1A (refrigerant system not shown), with correspondingly labelled components. The (optional) mixing chamber CM is provided within a casing CAS, having a port to which the first evaporator EVP1 is coupled for exhaust air flow A1, and (optionally) a further port for the inlet of ambient air flow A2. The illustrated (optional) mixing chamber CM is partitioned by a perforated screen PS to promote mixing of the exhaust air flow A1 from the first evaporator EVP1 and the ambient air flow A2, within the mixing chamber CM, before the air flows through the second evaporator EVP2 (e.g. mounted on the exterior of a housing H, and through the second conduit C2 within the housing H; alternatively the second evaporator EVP2 may be provided within the housing H or at the air outlet OUT). One or more air fans F1, F2, F3 may be provided to drive the air flow.

The heat pump system may be manufactured as a complete system, as shown in FIG. 2A. Alternatively, a heat pump adaptor system may be manufactured for a user to fit to a separate heat pump HP as shown in FIG. 2B, e.g. either for assembly to a pre-manufactured heat pump during manufacturing, or for retro-fitting to a previously installed heat pump.

Figure 2B:
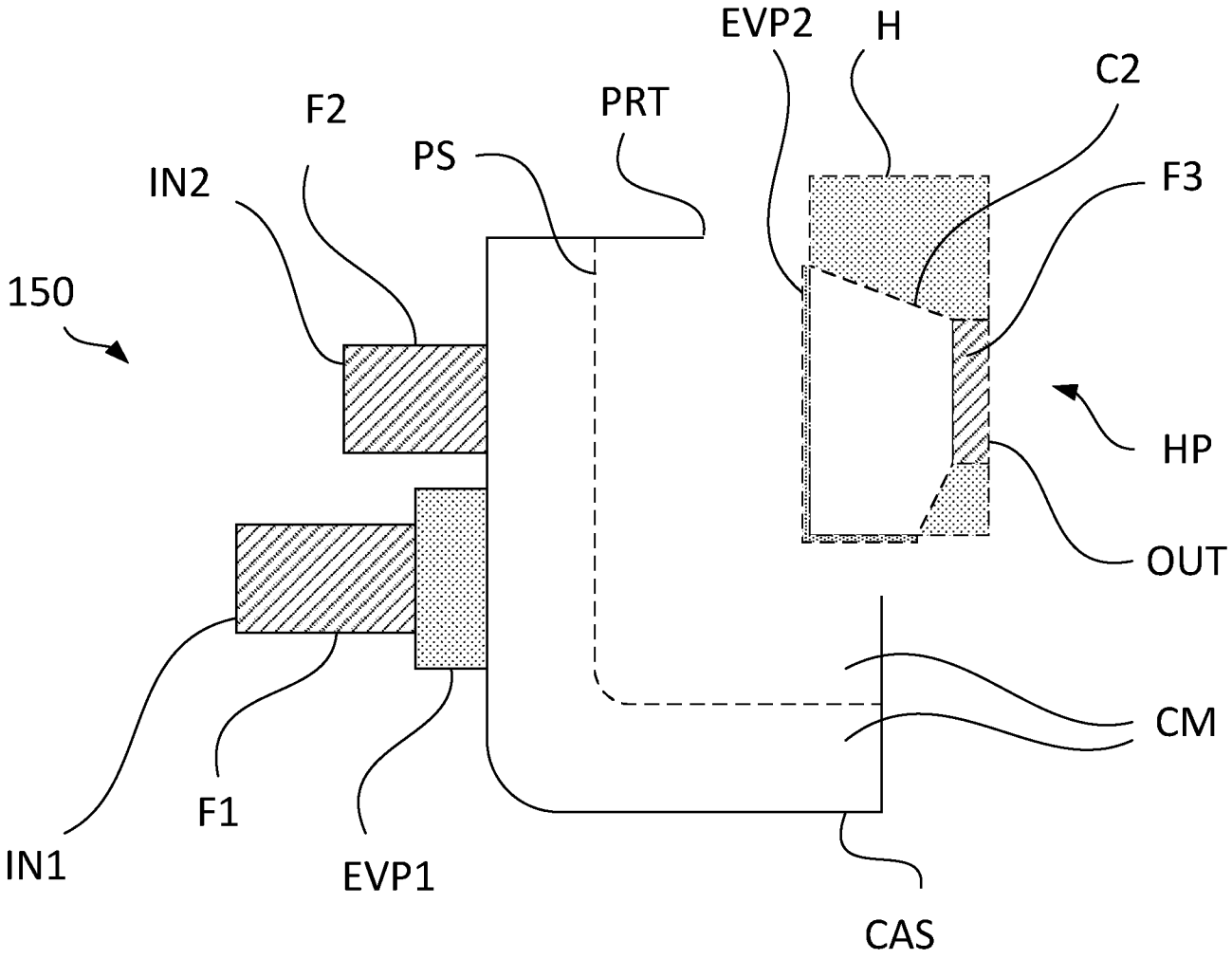
FIG. 2B shows a sectional view of a heat pump adaptor system for fitting to a heat pump to form a heat pump system.

FIG. 2B shows a sectional view of a heat pump adaptor system 150 for fitting to a heat pump HP to form a heat pump system 100 of FIGS. 1A and 2A. The heat pump adaptor system 150 comprises the first evaporator EVP1 within the first air flow conduit C1, and has a refrigerant flow path with the first throttle valve TEV1, the first evaporator EVP1, the heat exchanger HX and refrigerant ports or conduits (not shown) for coupling to the refrigerant circuit of the heat pump HP to form the heating mode streamed refrigerant circuit of the heat pump system 100 of FIG. 1A. The heat pump adaptor system 150 (optionally) comprises the mixing chamber CM and further port for the inlet of ambient air flow A2, similarly to the heat pump system 100 of FIG. 2A.

Commonly, existing heat pumps HP are provided on and within a cuboidal housing, commonly with the evaporator mounted on the exterior of the housing H, and an air inlet on a face of the housing, through which air is drawn by an air pump. The heat pump adaptor system 150 has a port PRT that is complementarily shaped for coupling to a heat pump, e.g. having a generally planar port for sealing around the air inlet, or having a port for sealing around the air inlet on two or more external faces of the heat pump HP. For example, the seal may be formed by connecting together fixings that hold a gasket under compression. In use, the mixed air from the mixing chamber CM flows through the second evaporator EVP2 in place of ambient air when the stand-alone heat pump HP is in conventional use.

The heat pump adaptor system 150 is fitted to the heat pump HP by connecting the refrigerant flow path of the heat pump adaptor system 150 with the refrigerant flow path of the heat pump HP, to form an integrated refrigerant flow path (e.g. as shown in FIG. 1A). The refrigerant flow path of the heat pump HP is coupled to the lower pressure inlet of the compressor COMP (e.g. a vapour injection compressor). The outlet of the first evaporator EVP1 is connected with the lower temperature inlet of the heat exchanger HX.

The heat pump system 100 of FIG. 1A has been described with a thermal load that is providing heat out of the condenser COND, for example to be used in heating a building.

Figure 3A:
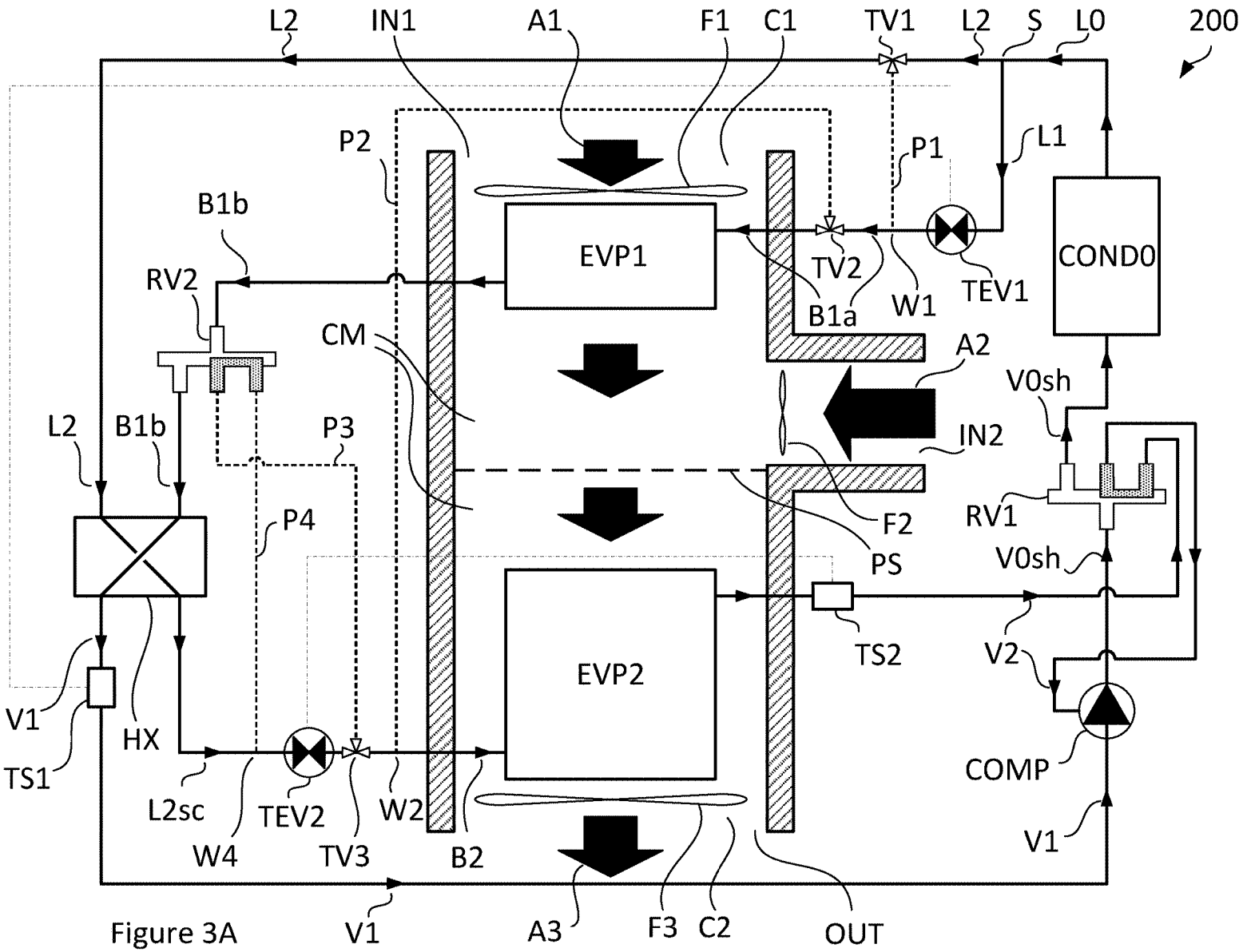
FIG. 3A schematically illustrates a further heat pump system, configured for a heating mode of operation.
Figure 3B:
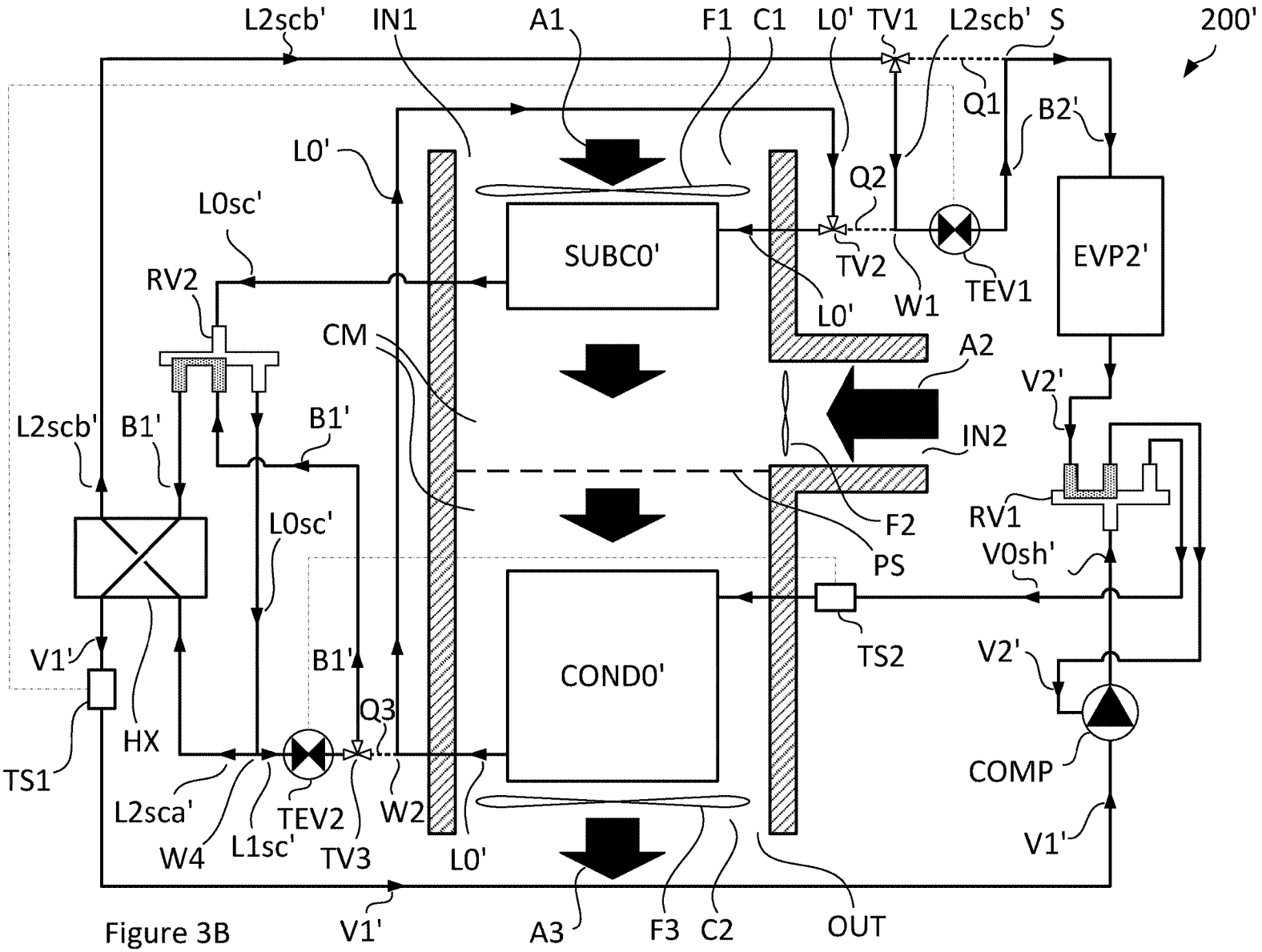
FIG. 3B schematically illustrates the further heat pump system of FIG. 3A, configured for a cooling mode of operation.
Figure 3C:
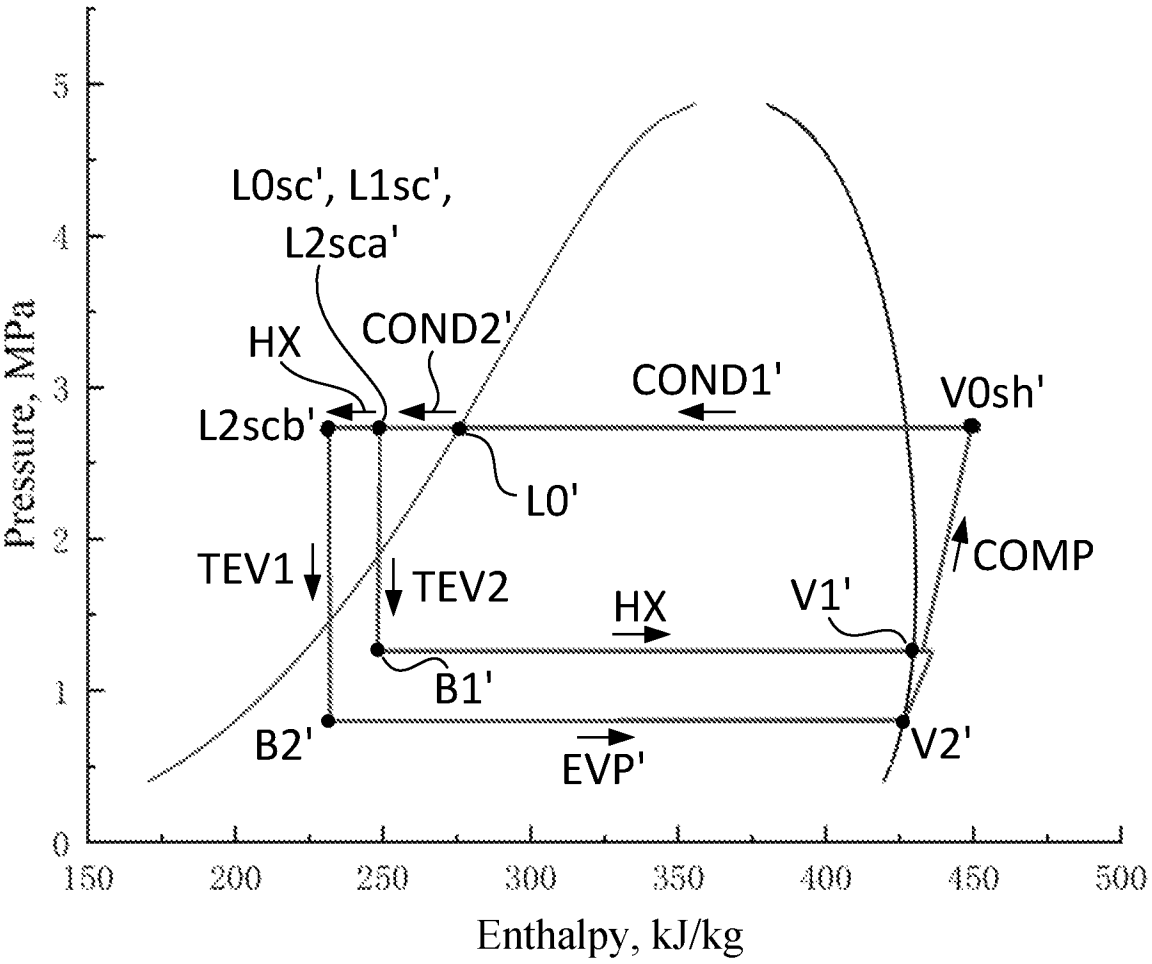
FIG. 3C shows a pressure-enthalpy diagram for the cooling mode operation of the further heat pump system, for the refrigerant R-410A, in the cooling mode configuration of FIG. 3B.

FIGS. 3A and 3B disclose a further heat pump system 200, which may be switched between operation in a heating mode and a cooling mode of operation. FIG. 3A shows the heat pump system 200 configured in the heating mode, and FIG. 3B shows the same heat pump system 200' configured in the cooling mode. FIG. 3C shows the pressure-enthalpy diagram for the heat pump system 200' in the cooling mode of operation of FIG. 3B.

In the cooling mode, the refrigerant flows the opposite way through the condenser COND0 (refrigerant-load heat exchanger) of the heating mode, which is operated as an evaporator EVP2' on the second stream, and absorbs heat (e.g. from within a building) as the thermal load to the heat pump 200'. In the cooling mode, the first evaporator EVP1 (first refrigerant-air heat exchanger) operates as a common subcooler SUBC0', and the second evaporator EVP2 (second refrigerant-air heat exchanger) of the heating mode operates as a common condenser COND0', with the refrigerant flowing through the common condenser in the opposite direction to its operation as the second evaporator EVP2.

The heating mode of operation of the heat pump system 200 of FIG. 3A corresponds with the heating mode of operation of the heat pump system 100 of FIG. 1A, and the pressure-enthalpy diagram of FIG. 1B. The heat pump 200 of FIG. 3A differs from the heating pump 100 of FIG. 1A by the addition of switchable valves and the addition of alternative refrigerant flow paths, which are shown in FIG. 3A by dotted lines. The alternative refrigerant flow paths are coupled to the refrigerant flow paths of the heat pump 100 of FIG. 1A by connectors, including switchable valves, and are switched into a closed configuration during the heating mode. In the illustrated heat pump 200, the switchable valves for switching the alternative refrigerant flow paths are three three-way valves TV1, TV2, TV3 and two four-way valves RV1, RV2 (which each switch to swap coupling between one pair of ports and another pair of ports):

In the heating mode configuration, the first four-way valve RV1 couples the output of the compressor COMP to the condenser COND, and couples the output of the second evaporator EVP2 to the lower pressure input of the compressor. In the cooling mode configuration, the first four-way valve RV1 couples the output of the compressor COMP to the input of the common condenser COND0', and couples the output of the evaporator EVP2' on the cooling mode second stream to the lower pressure input of the compressor.

A first switchable three-way valve TV1 is provided on the flow path between the heating mode stream splitting three-way connector S (in heating mode) and the heat exchanger HX, a first three-way connector W1 is coupled to the output (in heating mode) of the first throttle valve TEV1, and a first alternative refrigerant flow path P1 is coupled between them.

A second switchable three-way valve TV2 is coupled between the first three-way connector W1 and the input (in heating mode) to the first evaporator EVP1, a second three-way connector W2 is provided coupled to the input (in heating mode) to the second evaporator EVP2, and a second alternative flow path P2 is coupled between them.

A third switchable three-way valve TV3 is coupled between to the output of the second throttle valve TEV2, and a third alternative flow path P3 couples between the third switchable three-way valve TV3 and a port of the second four-way valve RV2.

A further three-way connector W4 is coupled between the heat exchanger HX and the input to the second throttle valve TEV2, and a further alternative flow path P4 couples between the further three-way connector W4 and a further port of the second four-way valve RV2.

In the heating mode configuration, the second four-way valve RV2 couples the output of the first evaporator EVP1 and the heat exchanger HX. In the cooling mode configuration, the second four-way valve RV2 couples the output of the subcooler SUBC0' to the further three-way connector W4, and so to both the input of the second throttle valve TEV2 and to the heat exchanger HX. Also in the cooling mode configuration, the second four-way valve RV2 couples from the third switchable three-way valve TV3 to the heat exchanger HX.

The heat pump system is switched from the heating mode 200 to the cooling mode 200', by switching all of the three-way valves TV1, TV2, TV3 and four-way valves RV1, RV2, opening the alternative flow paths P1-P4, and closing other flow paths Q1, Q2, Q3 (indicated in FIG. 3B). When the heat pump is switched from the heating mode 200 to the cooling mode 200', the first and second throttle valves TEV1, TEV2 may also be adjusted to change their refrigerant mass flow rates and the ratio of their refrigerant mass flow rates. (A heat pump system only for cooling mode operation may omit the other flow paths Q1, Q2, Q3, maintain the alternative flow paths P1-P4 permanently open, and will not require the arrangement of switchable valves TV1-TV3, RV1-RV2 and the corresponding three-way connectors W1-W4.)

In the cooling mode of operation 200', the refrigerant flow path forms a closed, streamed refrigerant circuit around which the refrigerant circulates, in use, which is described below, for the refrigerant R-410A, in relation to FIG. 3B. FIG. 3C shows the pressure-enthalpy diagram for the cooling mode operation of the heat pump system 200' of FIG. 3B, for the refrigerant R-410A.

In the cooling mode common refrigerant stream:

i. The compressor COMP (e.g. a vapour injection compressor) supplies a common flow of refrigerant as superheated vapour V0*sh* (e.g. 69° C., 2.73 MPa) to the first switchable four-way valve RV1. The compressor COMP has a higher pressure gas inlet and a lower pressure gas inlet, respectively receiving refrigerant flows V1' and V2'.

ii. The common flow of superheated vapour V0*sh* output from the compressor COMP passes through the first (switchable) four-way valve RV1 to the common condenser COND0' (second evaporator EVP2 in the heating mode), in which the common flow of refrigerant is condensed to a liquid L0' (e.g. 45° C., 2.73 MPa).

iii. The third three-way valve TV3 is closed to the liquid L0' output from the common condenser COND0' flowing to the second throttle valve TEV2, which instead flows along alternative flow path P2, through second three-way valve TV2, and into the common subcooler SUBC0', in which the common flow of liquid refrigerant L0' is subcooled (e.g. 30° C., 2.73 MPa) to a subcooled liquid L0*sc'*.

iv. The subcooled liquid L0*sc'* flows from the output of the common subcooler SUBC0', through the second four-way valve RV2, along alternative flow path P4 to the further three-way connector W4, where the common subcooled liquid refrigerant flow L0*sc'* is split into to two cooling mode streams of subcooled liquid refrigerant L1*sc'*, L2*sc'*.

In the cooling mode first refrigerant stream:

i. The flow of subcooled liquid refrigerant L1*sc'* (e.g. 30° C., 2.73 MPa) in the cooling mode first refrigerant stream flows through the second throttle valve (expansion valve) TEV2, in which the pressure is abruptly dropped, causing flash evaporation of the subcooled liquid refrigerant L1*sc'* to form a first binary phase refrigerant B1' (e.g. 11.9% dryness, 15° C., 1.26 MPa).

ii. The first binary phase refrigerant B1' flows through the third three-way valve TV3 to the second (switchable) four-way valve RV2, through which it flows to the heat exchanger (refrigerant-refrigerant heat exchanger) HX. In the heat exchanger HX the binary phase refrigerant B1' absorbs heat from the subcooled liquid L2*sca'* in the cooling mode second refrigerant stream, to form a cooling mode first refrigerant stream vapour V1' (e.g. saturation vapour, 15° C., 1.26 MPa).

iii. The cooling mode first refrigerant stream vapour V1' flows back to the higher pressure input of compressor COMP, where it is recombined with the cooling mode second refrigerant stream vapour V2' and compressed into a common flow of superheated vapour V0*sh'*. The temperature of the vapour V1' is measured by the first temperature sensor TS1.

In the cooling mode second refrigerant stream:

i. The subcooled liquid refrigerant L2*sca'* (e.g. 30° C., 2.73 MPa) in the cooling mode second refrigerant stream flows through the heat exchanger HX, passing heat to the binary phase refrigerant B1' in the cooling mode first refrigerant stream, to form a further subcooled liquid refrigerant L2*scb'* (e.g. 20° C., 2.73 MPa).

ii. The flow of further subcooled refrigerant L2*scb'* flows from the heat exchanger HX, through the first three-way valve TV1, along the first alternative flow path P1 and through the first throttle valve (expansion valve) TEV1, in which the pressure is abruptly dropped, causing flash evaporation of part of the subcooled refrigerant flow L2*scb'* to form a second binary phase refrigerant B2' at a lower temperature and pressure (e.g. 13.9% dryness, 0° C., 0.80 MPa) than the further subcooled liquid refrigerant L2*scb'*.

iii. The second binary phase refrigerant B2' flows through the cooling mode second stream evaporator EVP2', in which the residual liquid refrigerant is completely vaporised to form a cooling mode second stream vapour V2' (e.g. saturation vapour, 0° C., 0.80 MPa).

iv. The cooling mode second stream vapour V2' flows back to the lower pressure input of compressor COMP, where it is recombined with the cooling mode first refrigerant stream vapour V1' and compressed into a cooling mode common flow of superheated vapour V0*sh'*.

As a result of the transfer of heat from the subcooled liquid refrigerant L2*sca'* in the cooling mode second refrigerant stream to the binary phase refrigerant B1' in the cooling mode first refrigerant stream, within the heat exchanger (cooling mode first refrigerant stream-to-second refrigerant stream heat exchanger) HX the refrigerant exiting the first throttle valve TEV1 and entering the cooling mode second stream evaporator EVP2' has a reduced dryness, leading to more heat absorption by the second stream evaporator EVP2' and a higher Energy Efficiency Ratio (EER, which is the ratio of the cooling load to the power input).

The mass flow rate through the cooling mode second refrigerant stream (e.g. through the first throttle valve TEV1) may be higher than the mass flow rate through the cooling mode first refrigerant stream (e.g. through the second throttle valve TEV2). The ratio of mass flow rates of the cooling mode first refrigerant stream:second refrigerant stream may be between 0.25:1 and 0.05:1 (e.g. 9%:91%).

The ratio of mass flow rates in the cooling mode first and second refrigerant streams may be controlled in correspondence with the ambient air temperature, the exhaust air temperature, the condensation temperature (e.g. temperature of load water circulating to the cooling mode second stream evaporator EVP2'), and the power of the compressor COMP. The first throttle valve (expansion valve) TEV1 and the second throttle valve (expansion valve) TEV2 may be controlled to regulate the mass flow rates in the cooling mode second and first refrigerant streams, respectively.

The cooling mode first and second refrigerant streams in the heat pump system may be respectively provided with the first temperature sensor TS1 for measuring the temperature of the vapour V1' output from the heat exchanger HX and flowing to the higher pressure input of the compressor COMP, and the second temperature sensor TS2, for measuring the temperature of the common superheated vapour V0*sh'* output from the compressor COMP and flowing to the common condenser COND0'. The first and second temperature sensors TS1, TS2 respectively provide feedback used to control the second throttle valve TEV1 and the second throttle valve TEV2, in particular ensuring that the refrigerant is fully vaporised at the locations of the first temperature sensor TS1.

Examples of a suitable refrigerant for the cooling mode are R-410A and R-134A.

Advantageously, the (optional) introduction and mixing of ambient air flow A2 into the air flow of exhaust air flow A1 enables the heat pump system to absorb more heat, in total, from the air flow through the first and second conduits C1, C2 than is available from only the building exhaust air flow A1. Accordingly, the use of ambient air flow A2 enables the heat pump system 100 to extract a larger amount of heat than can be recovered only from the exhaust air flow A1, e.g. a single heat pump system can both absorb heat from the exhaust air and absorb additional heat from the ambient air, which may together supply all of the space cooling requirements of a building.

Advantageously, in the cooling mode, the exhaust air flow A1 (e.g. 20° C.) has a lower temperature than the ambient air flow A2 (e.g. 35° C.). The degree of subcooling of the refrigerant is increased by the subcooler SUBC0'. For a given the mass flow rate of refrigerant in the cooling mode second stream evaporator EVP2', this enables more heat to be absorbed in the evaporator EVP2' than with a conventional heat pump, leading to a higher cooling load and Energy Efficiency Ratio (EER).

The figures provided herein are schematic and not to scale.

Throughout the description and claims of this specification, the words "comprise" and "contain" and variations of them mean "including but not limited to", and they are not intended to (and do not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A heat pump system comprising:

a compressor (COMP);

a refrigerant-load heat exchanger (COND, EVP2');

a heating mode refrigerant flow splitter(S);

a refrigerant-to-refrigerant heat exchanger (HX);

a first expansion valve (TEV1);

a first refrigerant-air heat exchanger (EVP1, SUBC0');

a second expansion valve (TEV2);

a second refrigerant-air heat exchanger (EVP2, COND0');

a first air flow conduit (C1); and a second air flow conduit (C2);

wherein the heat pump system is configured or configurable for operation in a heating mode of operation for absorbing heat with the first refrigerant-air heat exchanger (EVP1) and the second refrigerant-air heat exchanger (EVP2) and for emitting heat from the refrigerant-load heat exchanger with a heating mode refrigerant flow path comprising:

the compressor has a first inlet coupled to receive a heating mode first refrigerant stream and a second inlet coupled to receive a heating mode second refrigerant stream;

the refrigerant-load heat exchanger is coupled to receive a heating mode common refrigerant flow from the compressor;

the heating mode refrigerant flow splitter for splitting the heating mode common refrigerant flow from the compressor into the heating mode first refrigerant stream and the heating mode second refrigerant stream; and the refrigerant-to-refrigerant heat exchanger coupled for transferring heat between the heating mode first refrigerant stream and the heating mode second refrigerant stream;

wherein the heating mode first refrigerant stream comprises:

the first expansion valve coupled to receive the heating mode first refrigerant stream from the heating mode refrigerant flow splitter;

the first refrigerant-air heat exchanger coupled to receive the heating mode first refrigerant stream from the first expansion valve; and the refrigerant-to-refrigerant heat exchanger coupling the heating mode first refrigerant stream from the first refrigerant-air heat exchanger to the compressor, wherein the heating mode second refrigerant stream comprises:

the refrigerant-to-refrigerant heat exchanger coupled to receive the heating mode second refrigerant stream from the heating mode refrigerant flow splitter to the second expansion valve;

the second expansion valve coupled to receive the heating mode second refrigerant stream from the refrigerant-to-refrigerant heat exchanger; and the second refrigerant-air heat exchanger being coupled to communicate with the heating mode second refrigerant stream from the second expansion valve to the compressor, wherein the first refrigerant-air heat exchanger is in the first air flow conduit with a first air inlet for receiving a first air flow, and the second refrigerant-air heat exchanger is in the second air flow conduit coupled to receive the first air flow.

2. The heat pump system according to claim 1, wherein the compressor is a vapour injection compressor.

3. The heat pump system according to claim 1, wherein:

the first refrigerant-air heat exchanger has a first external surface area for exposure to air in the first air flow conduit, the second refrigerant-air heat exchanger has a second external surface area for exposure to air in the second air flow conduit, and the second external surface area is larger than the first external surface area.

4. The heat pump system according to claim 1, wherein the first air flow conduit is provided with a first air pump for pumping air through the first air flow conduit.

5. The heat pump system according to claim 1, wherein the second air flow conduit is provided with a second air pump for pumping air through the second air flow conduit.

6. The heat pump system according to claim 1, wherein a mixing chamber having a second air inlet is provided for receiving and mixing air from the first air flow conduit and the second air inlet to form a mixed air flow and for coupling the mixed air flow to the second air flow conduit.

7. The heat pump system according to claim 6, wherein the second air inlet is provided with a third air pump for pumping air into the mixing chamber from the second air inlet.

8. The heat pump system according to claim 6, wherein the mixing chamber is provided with a perforated screen, and air from the first air flow conduit and the second air inlet are coupled to the second air flow conduit by passage through the perforated screen.

9. The heat pump system according to claim 1, comprising switchable valves for switching between the heating mode refrigerant flow path and the cooling mode refrigerant flow path wherein the heat pump system is configured for switching between the heating mode of operation and a cooling mode of operation for emitting heat from the first refrigerant-air heat exchanger and the second refrigerant-air heat exchanger and for absorbing heat with the refrigerant-load heat exchanger with a cooling mode refrigerant flow path comprising:

the compressor coupled to receive a cooling mode first refrigerant stream at the first inlet and a cooling mode second refrigerant stream at the second inlet;

the second refrigerant-air heat exchanger coupled to receive a cooling mode common refrigerant flow from the compressor;

the first refrigerant-air heat exchanger coupled to receive the cooling mode common refrigerant flow from the second refrigerant-air heat exchanger;

a cooling mode refrigerant flow splitter for splitting the common refrigerant flow into the cooling mode first refrigerant stream and the cooling mode second refrigerant stream; and the refrigerant-to-refrigerant heat exchanger coupled for transferring heat between the cooling mode first refrigerant stream and the cooling mode second refrigerant stream;

wherein the cooling mode first refrigerant stream comprises:

the second expansion valve coupling the cooling mode first refrigerant stream from the cooling mode refrigerant flow splitter to the refrigerant-to-refrigerant heat exchanger; and the refrigerant-to-refrigerant heat exchanger coupling the cooling mode first refrigerant stream to the compressor; and wherein the cooling mode second refrigerant stream comprises:

the refrigerant-to-refrigerant heat exchanger coupling the cooling mode second refrigerant stream from the cooling mode refrigerant flow splitter to the first expansion valve; and the refrigerant-load heat exchanger coupling the cooling mode second refrigerant stream from the first expansion valve to the compressor.

10. A method of heating a building provided with a heat pump system according to claim 1 the method comprising:

emitting heat from the refrigerant-load heat exchanger by circulating refrigerant through the heating mode refrigerant flow path; and passing building exhaust air through the first refrigerant-air heat exchanger and the second refrigerant-air heat exchanger.

11. The method of heating a building according to claim 10, wherein the heat pump system comprises a mixing chamber having a second air inlet for receiving and mixing the first air flow from the first air flow conduit and the second air flow from the second air inlet to form a mixed air flow and for coupling the mixed air flow to the second air flow conduit, the method comprising:

mixing a second air flow into the first air flow, and passing the mixed first and second air flows through the second refrigerant-air heat exchanger.

12. A method of cooling a building provided with a heat pump system according to claim 9, the method comprising:

absorbing heat with the refrigerant-load heat exchanger by circulating refrigerant through the cooling mode refrigerant flow path; and passing building exhaust air through the first refrigerant-air heat exchanger and the second refrigerant-air heat exchanger.

13. The method of cooling a building according to claim 12, wherein the heat pump system comprises a mixing chamber having a second air inlet for receiving and mixing the first air flow from the first air flow conduit and the second air flow from the second air inlet to form a mixed air flow and for coupling the mixed air flow to the second air flow conduit, the method comprising:

mixing a second air flow into the first air flow, and passing the mixed first and second air flows through the second refrigerant-air heat exchanger.

* * * * *